US008477986B1

(12) United States Patent
Kiser

(10) Patent No.: US 8,477,986 B1
(45) Date of Patent: Jul. 2, 2013

(54) AUDIENCE PARTICIPATION GLOVES

(76) Inventor: Mary Kiser, West Hollywood, CA (US)

( * ) Notice: Subject to any disclaimer, the term of this patent is extended or adjusted under 35 U.S.C. 154(b) by 414 days.

(21) Appl. No.: 12/753,269

(22) Filed: Apr. 2, 2010

Related U.S. Application Data

(60) Provisional application No. 61/171,458, filed on Apr. 22, 2009.

(51) Int. Cl.
*H04R 1/02* (2006.01)

(52) U.S. Cl.
USPC ..... 381/388

(58) Field of Classification Search
USPC ..... 381/388
See application file for complete search history.

(56) References Cited

U.S. PATENT DOCUMENTS

| | | | | |
|---|---|---|---|---|
| 3,638,011 | A * | 1/1972 | Bain et al. | 362/103 |
| 5,177,467 | A * | 1/1993 | Chung-Piao | 340/574 |
| 5,486,112 | A * | 1/1996 | Troudet et al. | 434/250 |
| 6,049,327 | A * | 4/2000 | Walker et al. | 345/158 |
| 6,529,121 | B2 * | 3/2003 | Bush | 340/326 |
| 6,592,235 | B1 * | 7/2003 | Mayo | 362/103 |
| 6,709,142 | B2 * | 3/2004 | Gyori | 362/554 |
| 6,725,729 | B1 * | 4/2004 | Cimmino | 73/849 |
| 6,974,225 | B2 * | 12/2005 | Weng | 362/103 |
| 7,163,308 | B2 * | 1/2007 | Ferrari et al. | 362/103 |
| 7,221,552 | B1 * | 5/2007 | Brown | 361/232 |
| 7,347,578 | B1 * | 3/2008 | Nourse | 362/103 |
| 7,891,831 | B2 * | 2/2011 | Chen | 362/103 |
| 7,959,314 | B1 * | 6/2011 | Rodriguez | 362/103 |
| 8,154,844 | B2 * | 4/2012 | Brown | 361/232 |
| 2004/0128736 | A1 * | 7/2004 | Raz et al. | 2/159 |
| 2004/0255361 | A1 * | 12/2004 | Senter et al. | 2/160 |
| 2008/0225514 | A1 * | 9/2008 | Stokes | 362/103 |
| 2011/0013337 | A1 * | 1/2011 | Brown | 361/232 |

* cited by examiner

*Primary Examiner* — Forrest M Phillips
(74) *Attorney, Agent, or Firm* — Allen D. Hertz, P.A.; Allen D. Hertz

(57) ABSTRACT

An audience interaction device is provided in the form factor of a glove. The glove can include a light emitting circuit including a series of lights disposed long finger receptacles of the glove. The light emitting circuit includes a series of lights, a portable power source, a switch, and wires providing electrical communication between the components. The circuit can include controls to provide a steady light output, a flashing output, a sequencing output, etc. The lights can be of a single color or multi colored. Chemiluminescence's can also be used for producing light. The device can include a noise generating device disposed upon a palm section of the glove. The noise generating device can be a mechanical device or an electrically drive noise generating apparatus. The electrically driven apparatus can be continuous, time based, or based upon proximity to an opposing glove.

12 Claims, 7 Drawing Sheets

AUDIENCE PARTICIPATION GLOVES

RELATED US PATENT APPLICATIONS

This Non-Provisional Patent Application claims priority to Provisional U.S. Application 61/171,458, filed Apr. 22, 2009, which is incorporated in its entirety by reference herein.

FIELD OF THE INVENTION

The present disclosure generally relates to personal expression devices. More particularly, the present disclosure relates to a glove comprising a series of lights and noisemakers allowing a wearer to express their emotions during an event or other outing.

BACKGROUND OF THE INVENTION

People attend events for entertainment. The events have a tendency for audience interaction, particularly events which drive the audiences emotions. Examples of such events include sports, concerts, and the like. Audience members desire to express their support for the participants and do so in many ways. Clapping, vocal expressions, standing, and the like are common forms of expressing their support. Other means include lighting lighters, turning on view screens of cell phones, use of air horns, waving of towels or noodles, and the like can be used as well.

There continues to be a need for new audience interaction devices.

SUMMARY OF THE INVENTION

The present disclosure is generally directed to an audience interaction device. In one aspect, the audience interaction device may include:

a glove comprising a hand covering with individual and independently movable finger and thumb sections; and a light circuit comprising a battery, a series of lights, an electrical connection between the series of lights and the battery, and a means for activating the circuit;

wherein the series of lights are disposed upon at least one of the finger and thumb sections.

In another aspect, the light circuit further comprises a circuit enabling various lighting modes, including steady, flashing, and the like.

In still another aspect, the series of lights can utilize Light Emitting Diodes (LED's).

In yet another aspect, the LED's can be multicolored allowing illumination in various colors. The circuit can control a change in single colors, strobing different colors, sequencing different colors, and the like.

The present disclosure further directs to an alternate exemplary embodiment of an audience interaction device. In one aspect, the audience interaction device may include:

a glove comprising a hand covering with individual and independently movable finger and thumb sections; and a noise generating apparatus disposed upon a palm section of the hand covering.

In a further aspect, the noise generating apparatus is mechanically driven by contacting a second noise generating apparatus disposed upon a palm section of a second glove.

In yet another aspect, the noise generating apparatus is electrically driven by a noise generating circuit, an electrically driven audio output device, and a portable power source.

In a still further aspect, the noise generating circuit is activated via a change in status of a proximity sensor and subsequently generates an audio output, wherein the proximity sensor is located within an opposing palm section of a second glove.

While another aspect allows the manufacturer/retailer to promote a character, a team, or any other branding item.

BRIEF DESCRIPTION OF THE DRAWINGS

The preferred embodiments of the disclosure will hereinafter be described in conjunction with the appended drawings provided to illustrate and not to limit the appended claims, where like designations denote like elements, and in which:

Like reference numerals refer to like parts throughout the several views of the drawings.

DETAILED DESCRIPTION

Figure 1:
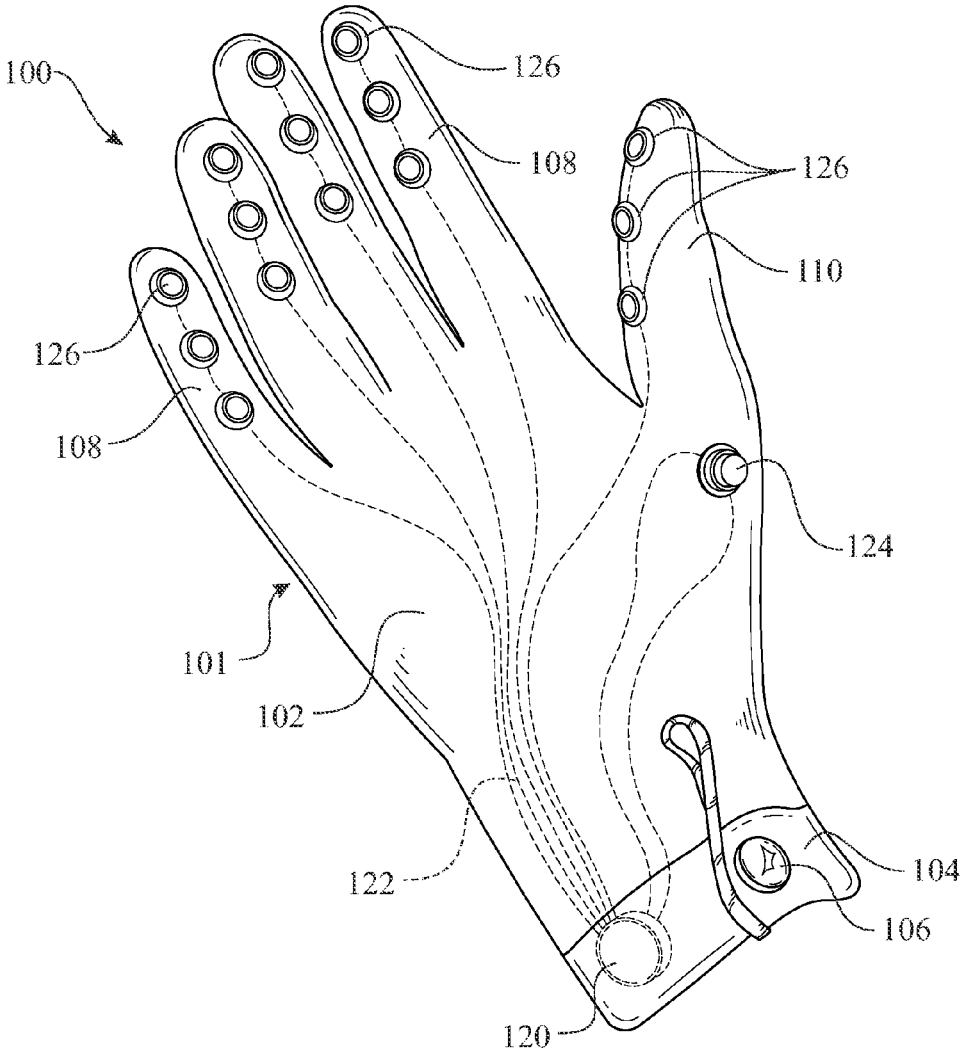
FIG. 1 is an audience interaction device being in a form of a glove comprising a plurality of lights, in accordance with a first exemplary embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

The present invention provides the user with an apparatus to express their emotions at an event. A first exemplary embodiment is referred to as an audience participate glove 100; illustrated in FIG. 1. The audience participate glove 100 is fabricated with the common elements of a glove 101, including a hand portion 102 for receiving a wearer's hand, a wrist band 104 for securing the audience participate glove 100 onto a wearer's hand, and finger receptacles, including a plurality of finger receiving portions 108 and a thumb receiving portion 110. A wristband securing fastener 106 can be of any form factor (shown as a snap) and is provided to tighten the wristband 104 about a wearer's wrist. The audience participate glove 100 further includes an illumination circuit. A series of lights 126 are disposed throughout the finger portions 108, 110 of the audience participate glove 100. The lights 126 are preferably of either incandescent bulbs or light emitting diodes (LED's). The LED's can be single color, dial color, or tri-color, where the tri-color can provide a multitude of colors by combining illuminated colors. It is preferable that the lights 126 are placed on the palm side of the finger portions 108, 110, as illustrated. The illumination circuit is powered via a portable power source 120. The portable power source 120 can be of any reasonable form factor, such as a button cell battery provided within the wristband 104. A power switch 124 can be incorporated, providing the wearer with the ability to control power to the circuit. The power switch 124 can additionally be utilized to change modes of the light circuit, which will be discussed in more detail in FIG. 6. A plurality of wires 122 provides electrical communication between each of the lights 126 and the portable power source 120. The wires 122 can be sandwiched between a liner and an outer portion of glove 101. It is understood that the audience participate glove 100 can be provided as a left and a right hand pair. The lights can be distributed within a hand portion 102 area as well as a backside of the glove 101.

Figure 2:
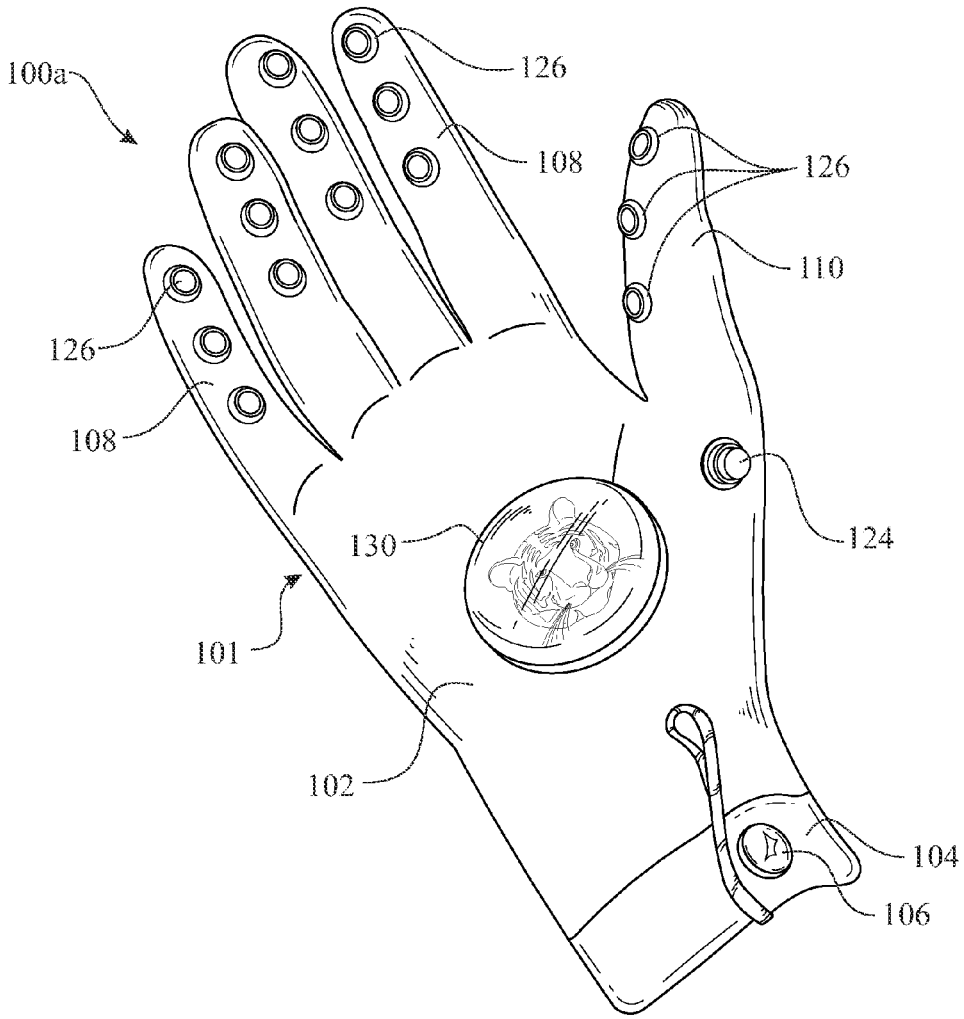
FIG. 2 is an audience interaction device being in a form of a glove comprising a plurality of lights, as in accordance with an enhanced version of the previously presented embodiment of FIG. 1.

An enhanced version of the audience participate glove 100 is best shown in FIG. 2, being referred to as a audience participate glove 100*a*, including all of the features described in FIG. 1, with the addition of a lighted medallion 130. The lighted medallion 130 can be of any illuminating means, including incandescent bulbs, Light emitting diodes, or a chemiluminescence's material. The electrically driven options would be in electrical communication with the portable power source 120 (FIG. 1) via the wires 122 (FIG. 1). The chemiluminescence's version comprises a plurality of receptacles containing the various isolated chemicals. The isolated chemicals are combined in any of many known means causing the chemiluminescence's. The lighted medallion 130 can include an image, a series of lights, and the like providing further accents to the audience participate glove 100*a*. The image can be representative of a branding, character, and the like. The lighting distributed about the glove 101 can also be formed into words or likenesses of branding, characters, and the like.

Figure 3:
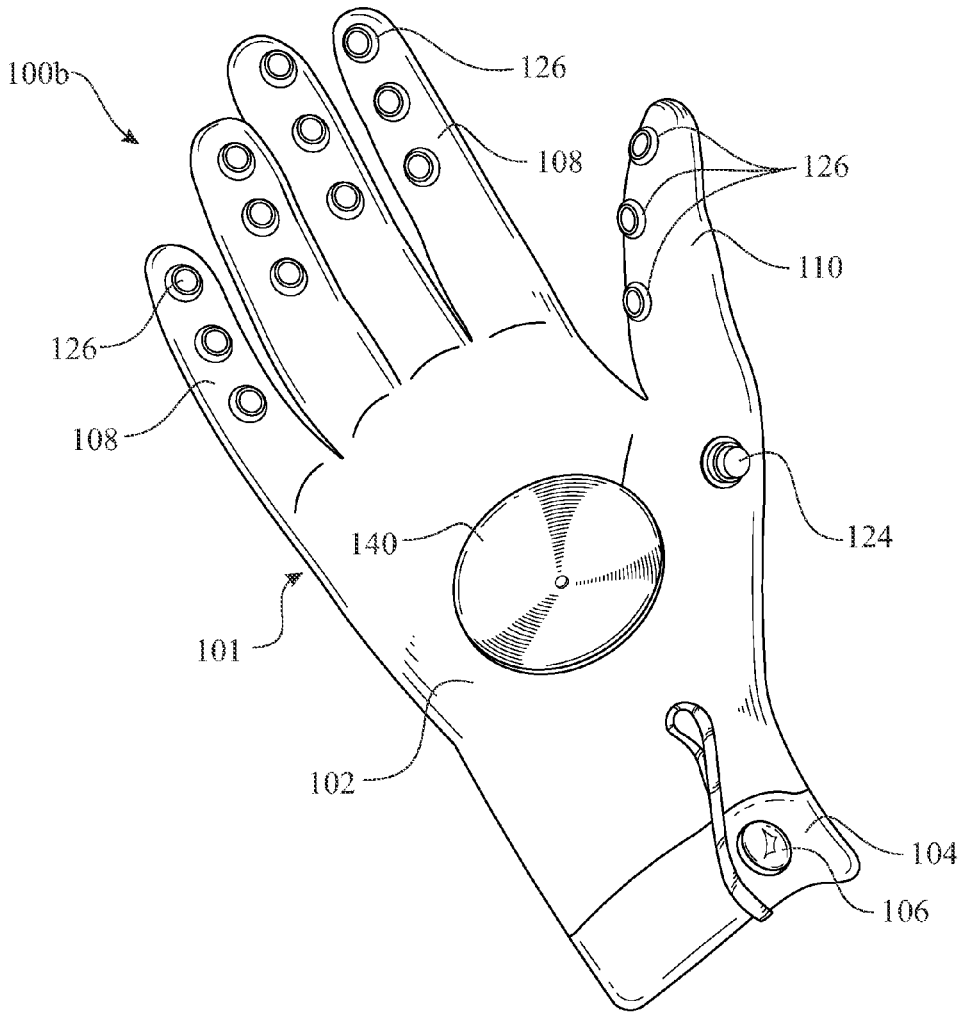
FIG. 3 is an audience interaction device being in a form of a glove comprising a plurality of lights and a mechanical noise generating apparatus.

A second enhanced version of the audience participate glove 100 is best shown in FIG. 3, being referred to as a audience participate glove 100*b*, including all of the features described in FIG. 1, with the addition of a mechanical noise generating member 140. The mechanical noise generating member 140 would be disposed upon the hand portion 102 of the glove 101 of each of a pair of gloves 101. The mechanical noise generating member 140 would generate a noise when the wearer claps their hands. The exemplary embodiment is of a cymbal style mechanical noise generator. Alternate form factors such as a bell, a horn, and the like can be utilized.

Figure 4:
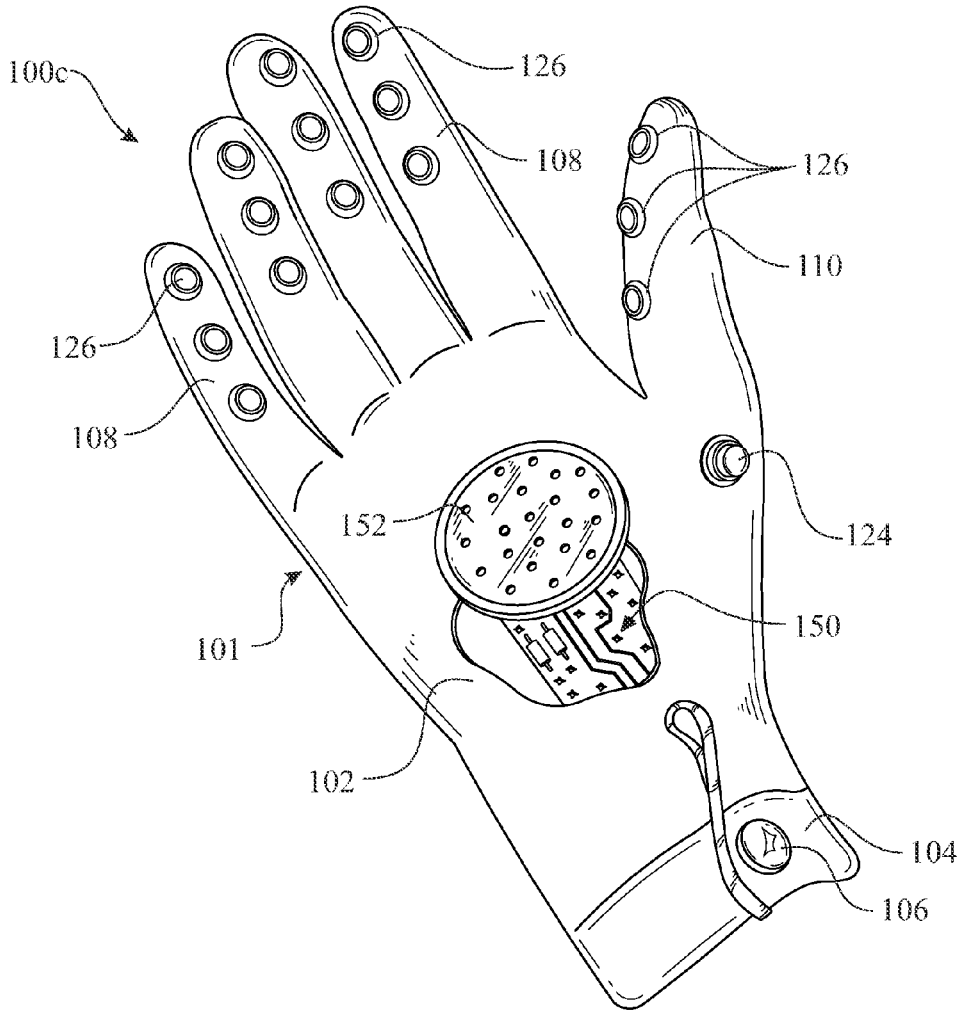
FIG. 4 is an audience interaction device being in a form of a glove comprising a plurality of lights and an electrically generating noise apparatus.
Figure 5:
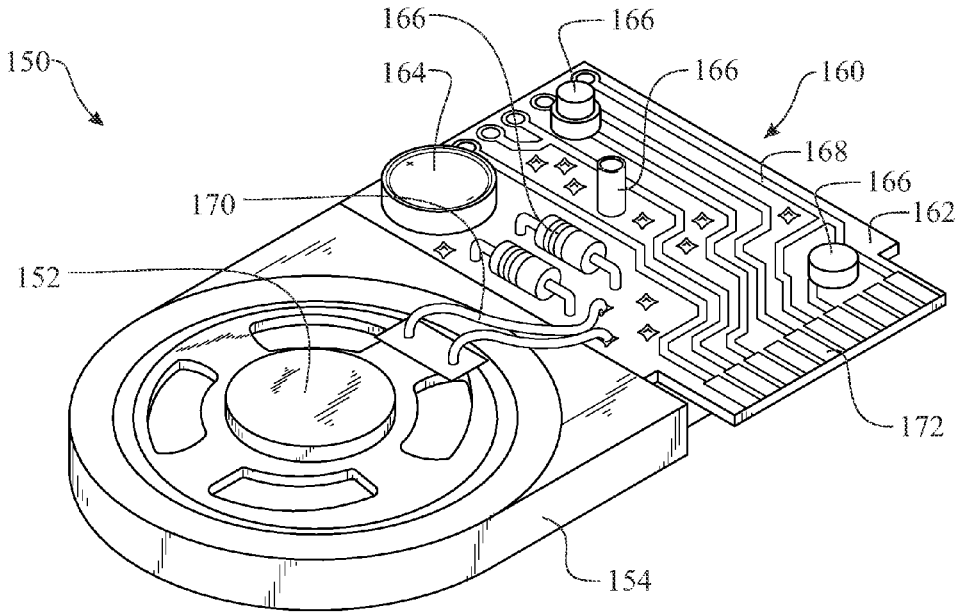
FIG. 5 is a detailed illustration of the electrically generating noise apparatus.

A third enhanced version of the audience participate glove 100 is best shown in FIGS. 4 and 5, being referred to as a audience participate glove 100*c*, including all of the features described in FIG. 1, with the addition of a electrically operated noise generating assembly 150. The electrically operated noise generating assembly 150 includes a speaker 152, which generates the audio output. The electrically operated noise generating assembly 150 includes the respective components and circuitry 160 to operate the speaker 152. The noise generating circuit 160 is supported via a circuit board 162. The circuit board 162 can include a battery 164, a plurality of electronic components 166, and conductive traces 168 providing electrical communication therebetween. Wires 170 provide electrical communication between the noise generating circuit 160 and the speaker 152. A connector 172 can be provided as a component of the noise generating circuit 160 as a means for interfacing with other components, including the power switch 124 and the series of lights 126. The speaker 152 is mechanically secured to either of the circuit board 162, the hand portion 102, or any other reasonable portion of the audience participate glove 100 via a speaker housing 154. The noise generating circuit 160 can include a proximity sensor as one of the electrical components 166 for sensing the proximity of the opposing glove 101. Padding can be placed between the electrically operated noise generating assembly 150 and the wearer's hand to ensure comfort and avoid any injury.

The noise generating circuit 160 is representative of any circuit for activating any of the features, including lights 126, noise, and the like. The proximity sensor can be utilized as a switch to activate the lights 126, noise, and the like. The proximity sensor would be activated when the left glove 101 and right glove 101 come together. The power switch 124 can be used to activate the entire system, wherein the lights would illuminate either by the power switch 124, be activated by the proximity sensor, or a combination thereof. One could power on the power switch 124. The inclusion of a power switch 124 ensures the features are not active even if the gloves are positioned against each other. The lights would remain off until the proximity sensor is activated. The circuit 160 can then illuminate the lights 126, generate a noise, or both over a predetermined period of time.

It is understood that an accelerometer can be utilize in place of the proximity switch, wherein the features are activated when the wearer moves the glove with a motion that is greater than a predetermined velocity or acceleration.

Figure 6:
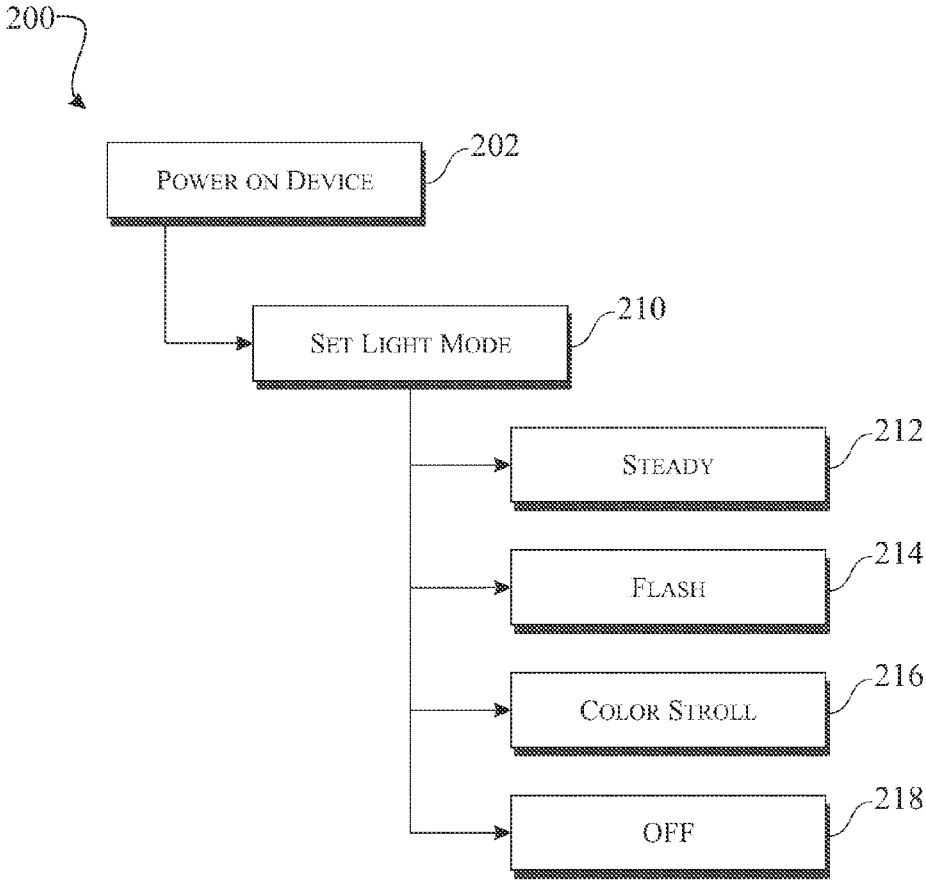
FIG. 6 is an exemplary illumination sequencing flow diagram.

An illumination control flow diagram 200 is presented in FIG. 6. The illumination control flow diagram 200 initiates with the user applying power 202 to the light circuit. The user can actuate a button, such as cycling the power switch 124, to set the light mode 210. The user can cycle the power switch 124 through several modes, such as a steady state 212, a flash mode 214, a color stroll mode 216, and power off 218. The steady state 212 would provide a constant single color display. The flash mode 214 would provide a flashing single or multiple color display. The color stroll mode 216 would provide a sequencing display in either a single color or a sequence of multiple colors. It is understood that a similar process can be applied to the sound. A plurality of digital sound files can be stored within a memory device of the noise generating circuit 160. The noise generating circuit 160 can include a mode controller which allows the user to select either a specific digital sound file, a series of digital sound files, a random selection of digital sound files, and the like.

Figure 7:
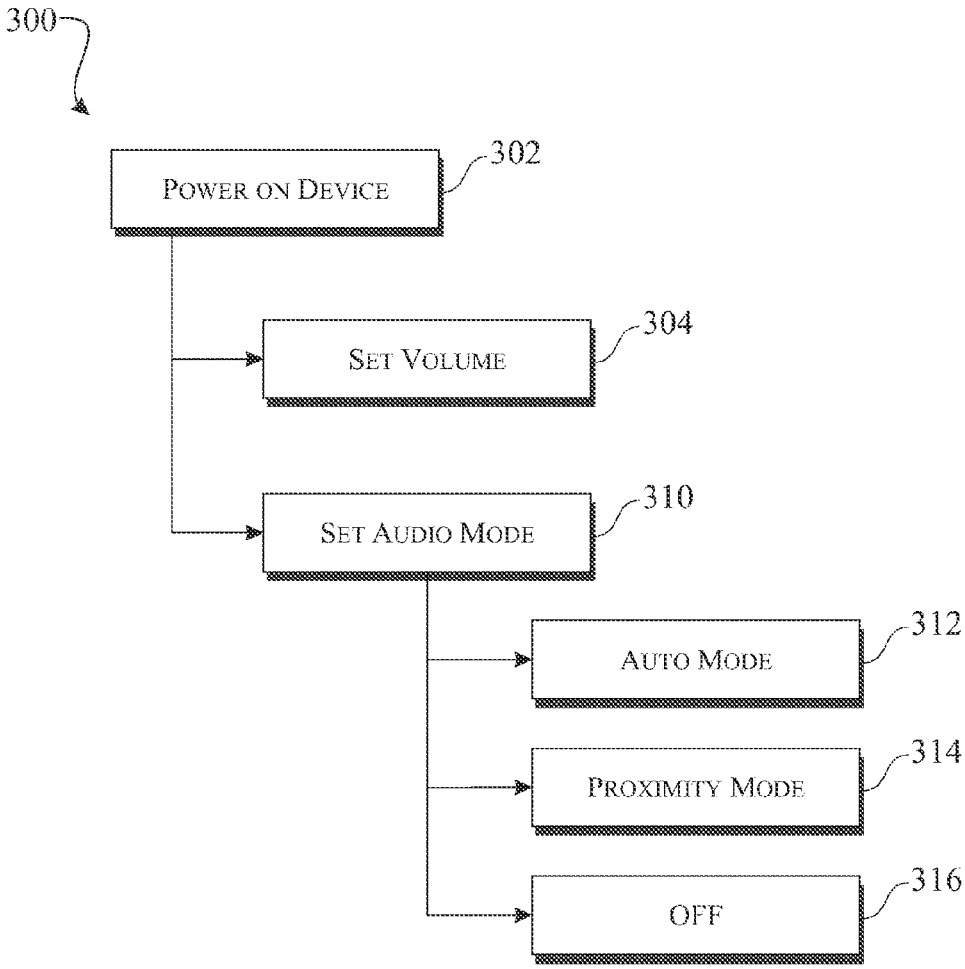
FIG. 7 is an exemplary electronic audio control flow diagram.

An electric noise generation diagram 300 is presented in FIG. 7. The electric noise generation diagram 300 initiates with the user applying power 302 to the electric noise generation circuit. The user can actuate a control (not shown, but well understood) to set the output volume 304. The user can cycle the noise generating circuit 160 through several modes, such as an automatic output mode 312, a proximity driven mode 314, and power off 316. The automatic output mode 312 would be operated via a drive circuit within the electric noise generation circuit. The drive circuit can provide a continuous noise output, pulse the noise output, or provide a single short noise output. The proximity driven mode 314 would cause a noise output based upon a status change of a proximity switch. The proximity switch would have a sensing component in a glove comprising the noise generating drive circuit and a mating, passive component in the opposing glove 101. As the two mating sensing components approach each other, the sensing component changes state, activating the noise generating drive circuit. The sensing component would change state when the two mating sensing components are separated. When the wearing party no longer desires to use the noise generating drive circuit, the wearer deactivates the circuit in accordance with the power off step 316. This can be accomplished via any known means, including a switch, removal of the battery, and the like.

Applicant identified an additional application of the present invention being an aid for crossing guards. The lights 126 can aid in obtaining the attention of drivers.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An audience interaction device, comprising:

a glove comprising a hand covering with individual and independently movable finger and thumb section, the glove defining a palm section by a positioning of the thumb section;

a noise generating circuit integrated into the glove, the circuit comprising a speaker, a battery, a sound generating circuit, an electrical connection between the speaker and the battery, and at least one activation switch for activating the circuit; and a series of lights disbursed about the palm side of the glove, wherein the speaker is assembled to the glove at a location to emit sound from the palm section of the glove and the lights are arranged to emit light from the palm section of the glove.

2. An audience interaction device as recited in claim 1, wherein one of the at least one activation switch provides general power to the circuit.

3. An audience interaction device as recited in claim 1, the audience interaction device further comprising a left and a right glove, wherein one of the at least one activation switch activates a sound generation portion of the circuit when the left glove and right glove are brought together.

4. An audience interaction device as recited in claim 1, wherein the lights are disposed upon at least one of the finger and thumb sections.

5. An audience interaction device as recited in claim 1, further comprising a plurality of illumination modes being operably controlled by the circuit.

6. An audience interaction device as recited in claim 5, wherein the plurality of illumination modes include at least one of a steady state mode, a flash mode, a sequencing mode, and a color stroll mode.

7. An audience interaction device as recited in claim 1, the audience interaction device further comprising a memory device integrated into the noise generating circuit, and at least one digital sound file stored within the memory device.

8. An audience interaction device as recited in claim 7, the audience interaction device further comprising a plurality of digital sound files stored within the memory device and a mode controller integrated into the circuit, wherein the mode controller selects and plays the digital sound file in accordance with the selected mode.

9. An audience interaction device, comprising:

a glove comprising a hand covering with individual and independently movable finger and thumb section, the glove defining a palm section by a positioning of the thumb section; and a light circuit comprising a battery, a series of lights, an electrical connection between the series of lights and the battery, and at least one light activation switch for activating the circuit; and a noise generating circuit integrated into the glove, the circuit comprising a speaker, a sound generating circuit, an electrical connection between the speaker and the battery, and at least one noise activation switch for activating the circuit;

wherein the series of lights are disbursed about the palm section of at least one of the finger, thumb, and hand covering sections, and wherein the speaker is assembled to the glove at a location to emit sound from the palm section of the glove.

10. An audience interaction device as recited in claim 9, the audience interaction device further comprising a left and a right glove, wherein one of the at least one activation switch activates a sound generation portion of the noise generating circuit when the left glove and right glove are brought together.

11. An audience interaction device as recited in claim 9, the audience interaction device further comprising a left and a right glove, wherein one of the at least one activation switch activates a light illuminating portion of the light circuit when the left glove and right glove are brought together.

12. An audience interaction device as recited in claim 9, the audience interaction device further comprising a mode controlling circuit, wherein the mode controlling circuit controls the operation of the lights and sound.

* * * * *